US006792853B2

(12) United States Patent
Mori et al.

(10) Patent No.: US 6,792,853 B2
(45) Date of Patent: Sep. 21, 2004

(54) STENCIL PRINTER

(75) Inventors: Tomiya Mori, Shibata-gun (JP); Masanori Takahashi, Shibata-gun (JP); Kazuyoshi Kobayashi, Shibata-gun (JP); Kengo Tsubaki, Shibata-gun (JP)

(73) Assignee: Tohoku Ricoh Co., Ltd., Shibata-gun (JP)

( * ) Notice: Subject to any disclaimer, the term of this patent is extended or adjusted under 35 U.S.C. 154(b) by 0 days.

(21) Appl. No.: 10/654,085

(22) Filed: Sep. 4, 2003

(65) Prior Publication Data

US 2004/0112231 A1 Jun. 17, 2004

(30) Foreign Application Priority Data

Dec. 13, 2002 (JP) ..... 2002-362498

(51) Int. Cl.[7] ..... B41C 1/14
(52) U.S. Cl. ..... 101/128.4; 101/116
(58) Field of Search ..... 101/128.4, 114, 101/115, 116, 127.1, 128.1, 128.21, 129

(56) References Cited

U.S. PATENT DOCUMENTS 5,640,904 A * 6/1997 Sato et al. ..... 101/128.4
5,816,149 A * 10/1998 Kagawa et al. ..... 101/128.4
5,845,571 A * 12/1998 Kurashige et al. ..... 101/120
5,953,985 A * 9/1999 Kobayashi ..... 101/116
6,371,016 B2 * 4/2002 Takasawa ..... 101/129
6,499,394 B1 * 12/2002 Kawagoe et al. ..... 101/128.1
6,571,698 B1 * 6/2003 Kawaga ..... 101/128.4
6,626,098 B1 * 9/2003 Kanamori ..... 101/128.4

* cited by examiner

*Primary Examiner*—Eugene H. Eickholt
(74) *Attorney, Agent, or Firm*—Oblon, Spivak, McClelland, Maier & Neustadt, P.C.

(57) ABSTRACT

A stencil printer of the present invention includes a print drum for wrapping a master therearound, a master making and conveying section for perforating a stencil paid out from a stencil roll while conveying it to thereby produce the master, a master stocking section for stocking the master being conveyed by the master making and conveying section, and a roller pair for conveying the master out of the master stocking section. A movable master guide selectively guides the stencil paid out from the stencil roll to the master stocking section or the roller pair. A stretching member adjoins the print drum and is movable between a contact position where it contacts the stencil present on the print drum to thereby exert a stretching force on the master and a released position where the former is released from the latter. The stretching member and movable master guide are interlocked to each other.

8 Claims, 7 Drawing Sheets

STENCIL PRINTER

BACKGROUND OF THE INVENTION

1. Field of the Invention

The present invention relates to a stencil printer for printing an image on a sheet or recording medium by wrapping a master or perforated stencil around a print drum. More particularly, the present invention relates to a stencil printer of the type including a stretching member configured to exert a stretching force on a master and master stocking means for stocking the master.

2. Description of the Background Art

A stencil for use in a stencil printer has a laminate structure made up of an about 2 μm to 8 μm thick, thermoplastic resin film and a porous support adhered to is each other. The porous support is formed of Japanese paper or synthetic fibers or a combination thereof. A thermal head or similar heating unit selectively perforates, or cuts, the thermoplastic resin film with heat in accordance with image data to thereby make a master. After the master has been wrapped around a print drum, a press roller or similar pressing member presses a sheet against the outer periphery of the print drum with the result that ink, fed to the inner periphery of the print drum, is transferred to the sheet via the porous portion of the print drum and the perforations of the master, thereby printing an image on the sheet.

During printing, the ink is passed through the fibers of, e.g., Japanese paper constituting the porous support of the master. Therefore, if the fibers are locally entangled in the form of clusters or if the fibers extend across the pores of the resin film, then the ink cannot be smoothly passed through the fibers. As a result, fiber marks appear in the solid portions of the resulting image or thin lines become discontinuous or blurted.

To obviate the above defects ascribable to fibers, there has been proposed a stencil including a porous support thinner than conventional one or consisting only of a thermoplastic resin film. However, the apparent mechanical strength of the conventional stencil is implemented by the porous support. In this respect, the stencil with such a thin porous support or consisting only of a thermoplastic resin film is noticeably lowered in mechanical strength because the thermoplastic resin film is thin.

Generally, the stencil is conveyed by a platen roller and master conveying means positioned downstream of the platen roller in the direction of sheet conveyance to clamping means mounted on the print drum while being guided by a guide plate. Because the print drum rotates, the master conveying means and guide plate should not be positioned excessively close to the print drum, so that they do not interfere with the clamping means. Consequently, the master with low mechanical strength slightly waves due to shrinkage ascribable to perforation, the curl of the film and so forth before the master reaches the clamping means. Should the stencil so waving be clamped by the clamping means, it would crease on the print drum due to the wave and would therefore make the resulting prints defective.

In light of the above, Japanese Patent Laid-Open Publication No. 2001-353949, for example, discloses a stencil printer including a stretching member adjoining the outer periphery of a print drum and configured to stretch a master being wrapped around the print drum, see pages 3 through 5 and FIG. 1. The stretching member prevents the master from creasing on the print drum.

Today, a stencil printer of the type automatically performing a sequence of steps of discharging a used master, making a master, feeding the master, printing and so forth is predominant over the other stencil printers, In this type of stencil printer, the printing step is executed after the master discharging, master making and master feeding steps. However, the problem with the conventional stencil printer, which executes the master making step after the master discharging step, is that the next master cannot be made until the end of the master discharging step, extending so-called first print time.

Japanese Patent Laid-Open Publication No. 2002-103565, for example, teaches a stencil printer including master stocking means configured to stock a master and making the next master in parallel with the master discharging step or during printing, thereby reducing the first print time and therefore enhancing efficient operation, see pages 5 through 11 and FIG. 1.

In Laid-Open Publication No. 2001-353949 mentioned above, considering the fact that the stretching member should not be positioned excessively close to the print drum, the stretching member is configured to be movable between a position close to the print drum and a position remote from the same. Also, in Laid-Open Publication No. 2002-103565, a movable master guide, positioned in the upper portion of the master stocking means, is movable between a position where the guide guides the leading edge of a master toward master conveying means downstream of the master stocking means and a position where the guide does not obstruct the entry of the master in the master stocking means.

A stencil printer can free a master from creases and enhance efficient operation at the same time if provided with both of the stretching member and master stocking member. This configuration, however, increases the cost of the stencil printer because particular moving means must be assigned to each of the stretching member and movable master guide.

Technologies relating to the present invention are also disclosed in, e.g., Japanese Patent Laid-Open Publication No. 6-293176 and 7-125399.

SUMMARY OF THE INVENTION

It is an object of the present invention to provide a stencil printer capable of freeing a master from creases and enhancing efficient operation at the same time without increasing the cost.

A stencil printer of the present invention includes a print drum for wrapping a master therearound, a master making and conveying section for perforating a stencil paid out from a stencil roll while conveying it to thereby produce the master, a master stocking section for stocking the master being conveyed by the master making and conveying section, and a roller pair for conveying the master out of the master stocking section. A movable master guide selectively guides the stencil paid out from the stencil roll to the master stocking section or the roller pair. A stretching member adjoins the print drum and is movable between a contact position where it contacts the stencil present on the print drum to thereby exert a stretching force on the master and a released position where the former is released from the latter. The stretching member and movable master guide are interlocked to each other.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
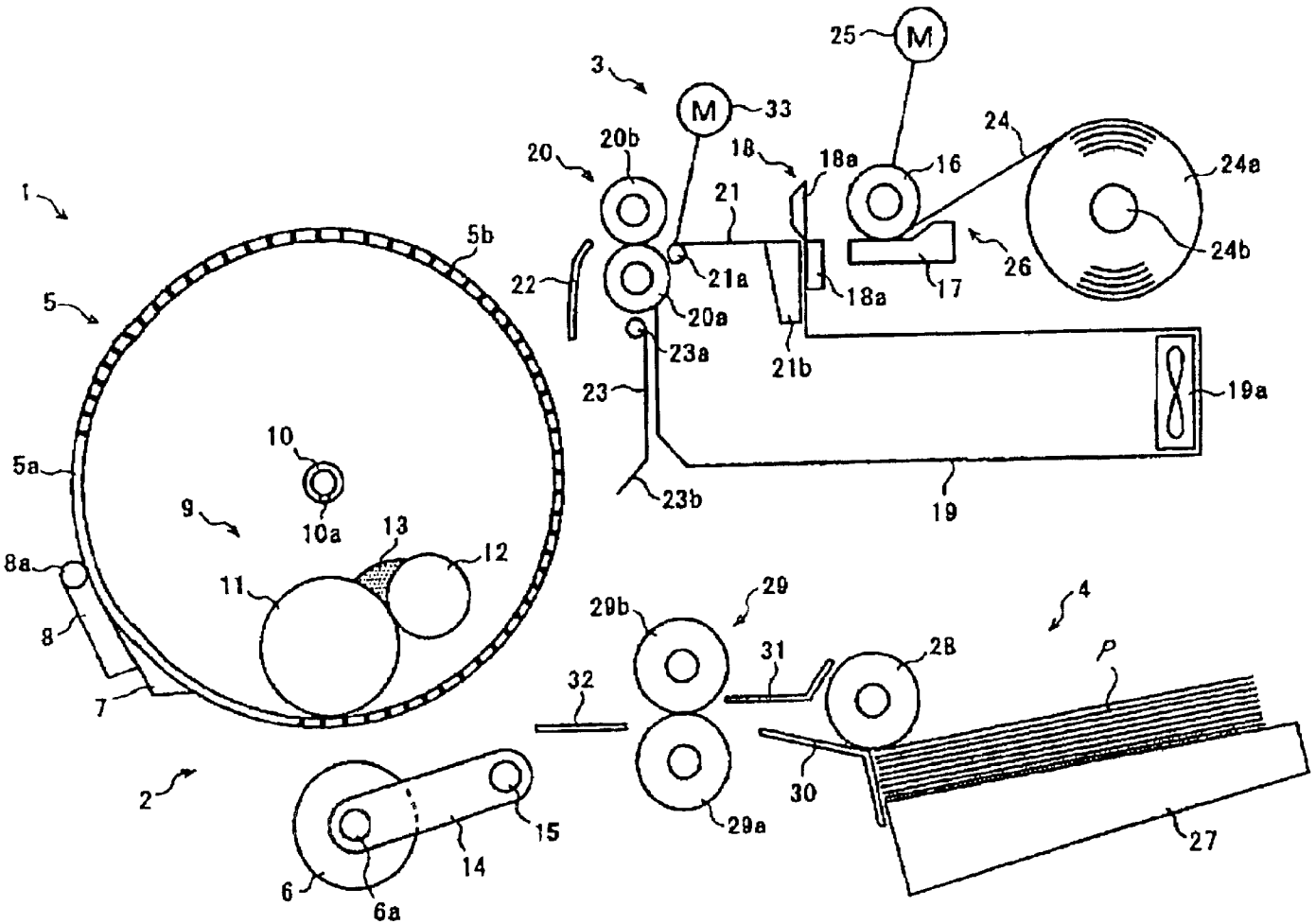
FIG. 1 is a front view showing a stencil printer embodying the present invention in a stand-by condition.

Referring to FIG. 1 of the drawings, a stencil printer embodying the present invention is shown and generally designated by the reference numeral 1. As shown, the stencil printer 1 is generally made up of a printing section 2, a master making and conveying section 3, and a sheet feeding section 4.

The printing section 2 includes a print drum 5 and a press roller 6. The print drum 5 is positioned at substantially the center of a printer body, not shown, and caused to rotate clockwise, as viewed in FIG. 1, by print drum drive means not shown. The press roller 6 is movable toward and away from the print drum 5 and presses a sheet or recording medium P fed from the sheet feeding section 4 against the print drum 5 when moved toward the print drum 5.

The print drum 5 has a pair of flanges at axially opposite ends thereof although not shown specifically. A porous support 5*a* is affixed to the circumferences of the flanges at opposite edges thereof. A plurality of mesh screens are laminated on the outer periphery of the porous support 5*a*. The porous support 5*a* includes a porous portion formed with a plurality of pores 5*b*. A stage 7 is mounted on the non-porous portion of the porous support 5*a* and includes a flat surface extending in the axial direction of the print drum 5. A clamper 8 is hinged to the stage 7 by a shaft 8*a* so as to be angularly movable toward and away from the stage 7 about the shaft 8*a*. More specifically, when the print drum 5 is rotated to a preselected position, opening/closing means, not shown, opens and then closes the clamper 8.

Ink feeding means 9 is arranged inside the print drum 5 and includes an ink feed pipe 10, which plays the role of a print drum shaft at the same time, an ink roller 11, and a doctor roller 12. The ink feed pipe 10 extends between the flanges of the print drum 5 and rotatably support the flanges via bearings not shown. An ink pump and an ink pack are connected to the ink feed pipe 10 although not shown specifically. The ink pump feeds ink under pressure from the ink pack to the inside of the print drum 5 via the holes 10*a* formed in the ink feed pipe 10.

The ink roller 11 extends between the flanges of the print drum 5 and is rotatably supported by a pair of side walls, not shown, which are affixed to the ink feed pipe 10. A drive means, not shown, causes the ink roller 11 to rotate in the same direction as and in synchronism with the print drum 5. The circumferential surface of the ink roller 11 is spaced from the inner periphery of the print drum 5 by a small gap.

The doctor roller 12 adjoins the ink roller 11 and is also rotatably supported by the side walls supporting the ink roller 11. Drive means, not shown, causes the doctor roller 12 to rotate in synchronism with, but in the opposite direction to, the ink roller 11. The circumferential surface of the doctor roller 12 and that of the ink roller 11 are spaced from each other by a small gap.

The portions of the ink roller 11 and doctor roller 12 adjoining each other form an ink well 13 having an wedge-like section therebetween. The ink, fed via the holes 10*a* to the ink well 13, deposits on the ink roller 11 in the form of a thin layer when passing between the adjoining portions of the ink roller 11 and doctor roller 12. Subsequently, when the press roller 6 is pressed against the print drum 5, the inner periphery of the print drum 5 contacts the ink roller 11 with the result that the ink is transferred from the ink drum 11 to the print drum 5.

The press roller 6, positioned below the print drum 5, has substantially the same axial length as the print drum 5 and is made up of a core 6*a* and a rubber or similar elastic member wrapped around the core 6*a*. The axially opposite ends of the core 6*a* are rotatably supported by one end of a pair of press roller arms 14 (only one is visible). The other ends of the press roller arms 14 are affixed to a press roller shaft 15, which is journalled to the printer body. Moving means, not shown, causes the press roller arms 14 to angularly move together via the press roller shaft 15. The press roller 6 is therefore movable between a released position where the roller 6 is released from the print drum 5, as shown in FIG. 1, and a contact position where the former contacts the latter.

The master making and conveying section 3, positioned above the printing section 2, includes a pair of master holding members, not shown, a platen roller 16, a thermal head 17, cutting means 18, master stocking means 19, a roller pair or master conveying means 20, a movable master guide 21, a master guide 22, and a stretching member 23. A stencil 24 is implemented as a stencil roll 24*a* and made up of a thermoplastic resin film and a porous support adhered to each other. The master holding members are mounted on a pair of side walls, not shown, included in the master making section 3 and support the core 24*b* of the stencil roll 24*a* such that the roll 24*a* is rotatable and removable.

The platen roller 16, positioned at the left-hand side of the stencil roll 24*a*, has axial length substantially identical with the width of the stencil 24 and journalled to the side walls of the master making section 3. A stepping motor 25, mounted on the printer body, causes the platen roller 16 to rotate clockwise, as viewed in FIG. 1.

The thermal head 17, positioned below the platen roller 16, has greater length than the platen roller 16 in the widthwise direction and has a number of heat generating elements arranged on its surface. Biasing means, not shown, constantly biases the thermal head 17 such that the heat generating elements contact the platen roller 16. A thermal head driver, not shown, selectively energizes the heat generating elements in accordance with image data fed from an image reading section, not shown, positioned in the upper portion of the printer body. The thermal head 17 and platen roller 16 constitute master making and conveying means 26 for selectively perforating, or cutting, the stencil 24 to thereby make a master while conveying the stencil 24.

The cutting means 18, positioned at the left-hand side of the master making and conveying means 26, has a conventional configuration including a lower edge 18*a* and an upper edge 18*b*. The lower edge 18*a* is mounted on a lower edge holder, not shown, affixed to the printer body and greater in width than the stencil 24. The upper edge 18*b* is mounted on an upper edge holder, not shown, and configured to move in the widthwise direction of the stencil 24 while rolling on the lower edge 18*a*.

The master stocking means 19, positioned at the left-hand side of the cutting means 18 and formed with an opening in the top, temporarily stocks the master (also labeled 24 hereinafter) cut away from the stencil 24 by the cutting means 18. More specifically, the master stocking means 19 is implemented as a box whose inside is partitioned by a plurality of plates not shown. A suction fan 19*a* is disposed in the deepest portion of the above box and operated to produce vacuum in the hermetically closed space of the master stocking means 19. In this condition, the master 24, conveyed from the master making and conveying means 26 via the cutting means 18, is introduced into the master stocking means 19 toward the deepest position.

The roller pair 20, positioned at the left-hand side of the master stocking means 19, is made up of a drive roller 20*a* and a driven roller 20*b* both of which are journalled to the side walls of the printer body. The drive roller 20*a* is caused to rotate by drive means, not shown, while the driven roller 20*b* is pressed against the drive roller 20*a*. The drive roller 20*a* and driven roller 20*b* therefore convey the master 24 by nipping it therebetween. A one-way clutch, not shown, is associated with the drive roller 20*a*.

The movable master guide 21 is positioned above the opening of the master stocking means 19 and affixed at one end to a shaft 21*a*, which is journalled to the side walls of the printer body A projection 21*b* protrudes from the other end or free end of the movable master guide 21 downward, as illustrated. A stepping motor 33, also included in the master making and conveying section 3, selectively moves the movable master guide 21 to a guide position, FIG. 1, where the guide 21 guides the master 24 toward the roller pair 20, a retracted position where the guide 21 does not obstruct the entry of the master 24 in the master stocking means 19 or a wrapping position where the projection 21*b* abuts against and moves the stretching member 23. To allow the projection 21*b* to abut against the stretching member 23, the side wall of the master stocking means 19, facing the stretching member 23, is formed with an opening not shown.

The master guide 22, positioned at the left-hand side of the roller pair 20, guides the master 24 being conveyed by the roller pair 20 toward the printing section 2. The master guide 22 is affixed to the side walls of the printer body.

The stretching member 23, positioned below the roller pair 20 at the left hand side of the master stocking means 19, is supported at one end by a shaft 23*a* journalled to the side walls of the printer body. Biasing means, not shown, constantly biases the stretching member 23 clockwise, as viewed in FIG. 1, about the shaft 23*a* while a stop, not shown, holds the stretching member 23 in the initial position shown in FIG. 1. In this configuration, the stretching member 23 is movable clockwise when pressed by the projection 21*b*, exerting a stretching force on the master 24 when the master 24 is to be wrapped around the print drum 5. The movement of the stretching member 23 will be described more specifically later.

The other end or free end of the stretching member 23 remote from the shaft 23*a* is implemented as a rectangular, thin contact portion 23*b* formed of polyethylene terephthalate resin or similar elastic material. When the stretching member 23 is moved to contact the master 24, the contact portion 23*b* exerts a preselected degree of pressure on the master 24 while elastically deforming itself.

The sheet feeding section 4, positioned below the master making and conveying section 3 at the right-hand side of the printing section 2, includes a sheet tray 27, a pickup roller 28, and a registration roller pair 29. The sheet tray 27 is loaded with a stack of sheets P and supported by the printer body in such a manner as to be movable in the up-and-down direction. Tray elevating means, not shown, causes the sheet tray 27 to selectively move upward or downward.

The pickup roller 27 is positioned above the sheet tray 27 at a position corresponding to the leading edge of the sheet stack P in the direction of sheet conveyance. The pickup roller 27, having a high frictional resistance member on its surface, is journalled to the side walls of the printer body and constantly biased downward, as viewed in FIG. 1, by biasing means not shown. When the tray elevating means raises the sheet tray 27 to a sheet feed position, the pickup roller 28 presses the top sheet P on the sheet tray 27 with a preselected degree of pressure. The pickup roller 28 is then rotated clockwise, as viewed in FIG. 1, by a sheet feed motor, not shown, also included in the sheet feeding section 4.

A separating member 30 is located below the pickup roller 28 at a position downstream of the leading edge of the sheet stack P on the sheet tray 27 in the direction of sheet conveyance. The separating member 30, implemented as a high frictional resistance member, is constantly pressed against the pickup roller 28 by biasing means not shown.

The registration roller pair 29, positioned downstream of the pickup roller 28 and separating member 30 in the direction of sheet conveyance, is made up of a drive roller 29*a* and a driven roller 29*b* both of which are journalled to the side walls, not shown, of the sheet feeding section 4. The drive roller 29*a* is driven by drive means, not shown, while the driven roller 29*b* is pressed against the drive roller 29*a*. The registration roller pair 29 stops the sheet P paid out from the sheet tray 27 by the pickup roller 28 and then starts conveying it toward the position where the print drum 5 and press roller 6 face each other at preselected timing.

A sheet guide 31 is positioned between the pickup roller 28 and the registration roller pair 29 while a sheet guide 32 is positioned downstream of the registration roller pair 29 in the direction of sheet conveyance. The sheet guides 31 and 32 are affixed to side walls, not shown, included in the sheet feeding section 4.

The document reading section mentioned earlier reads a document image and sends image data representative of the document image to an image memory not shown. The image memory thus stored in the image memory are called later and then formed in the stencil 24 by the thermal head 17.

A master discharging section is arranged above the printing section 2 at the left-hand side although not shown specifically. The master discharging section has a conventional configuration and includes a master discharging member for removing a used master from the print drum 5. The master discharging section additionally includes a waste master box for storing the used master removed from the print drum 5 and a compressor for compressing the used master introduced into the waste master box.

A sheet discharging section is arranged below the printing section 2 at the left-hand side although not shown specifically either. The sheet discharging section, configured to discharge the sheet or print P come out of the printing section 2 to the outside of the printer body, includes a peeler for peeling off the sheet P from the print drum 5, a conveyor for conveying the sheet P, and a print tray on which such sheets P are to be sequentially stacked.

Figure 2:
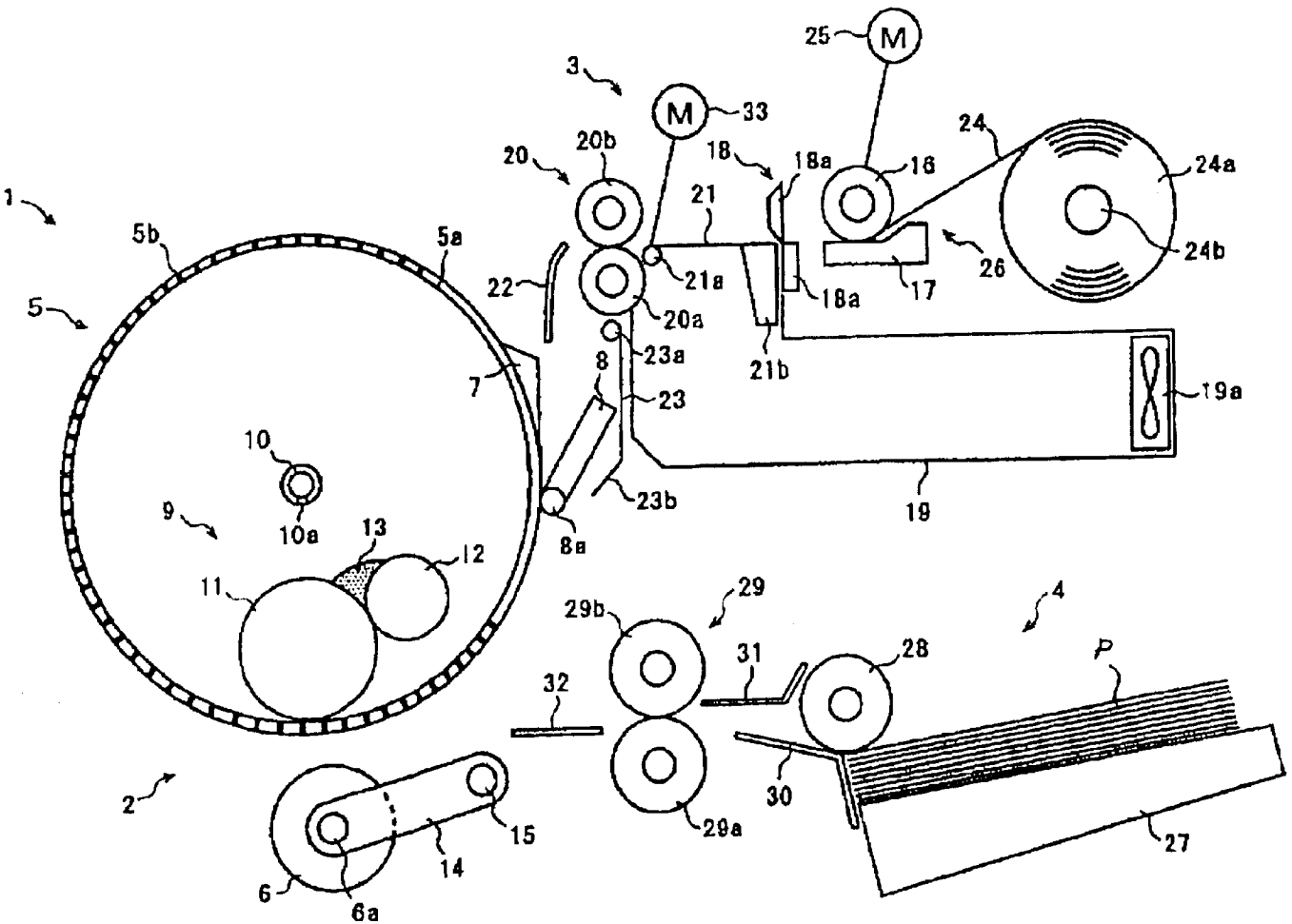
FIG. 2 is a front view showing the illustrative embodiment in a master feed stand-by condition.

The operation of the stencil printer 1 having the above construction will be described hereinafter. First, the operator of the printer 1 sets a desired document on the image reading section and then presses a perforation start key positioned on an operation panel, not shown, which is mounted on the top of the printer body. In response, the printer 1 performs an image reading operation and a master discharging operation in parallel. After the discharge of a used master, the print drum 5 is rotated to and then stopped at a master feed position where the clamper 8 faces substantially sideways. The clamper 8 is then opened by the opening/closing means mentioned earlier. In this condition, the printer 1 remains in a master feed stand-by position shown in FIGS. 1 and 2.

The master making and conveying section 3 performs master making operation in parallel with the image reading operation. More specifically, when the perforation start key is pressed, as stated earlier, the stepping motor 25 is energized to rotate the platen roller 16. At the same time, the drive means drives the roller pair 20 so as to pull out the stencil 24 from the stencil roll 24*a*. The stencil 24 thus pulled out is perforated in accordance with the image data when being conveyed through the master making and conveying means 26.

As soon as the roller pair 20 nips the leading edge of the stencil 24, the drive means is deenergized to stop rotating the roller pair 20 while, at the same time, the stepping motor 33 is deenergized. At this instant, the movable master guide 21 is rotated clockwise, as viewed in FIG. 2, to the retracted position shown in FIG. 3. Further, the suction fan 19*a* is turned on at the same time as the start of operation of the stepping motor 33.

Figure 3:
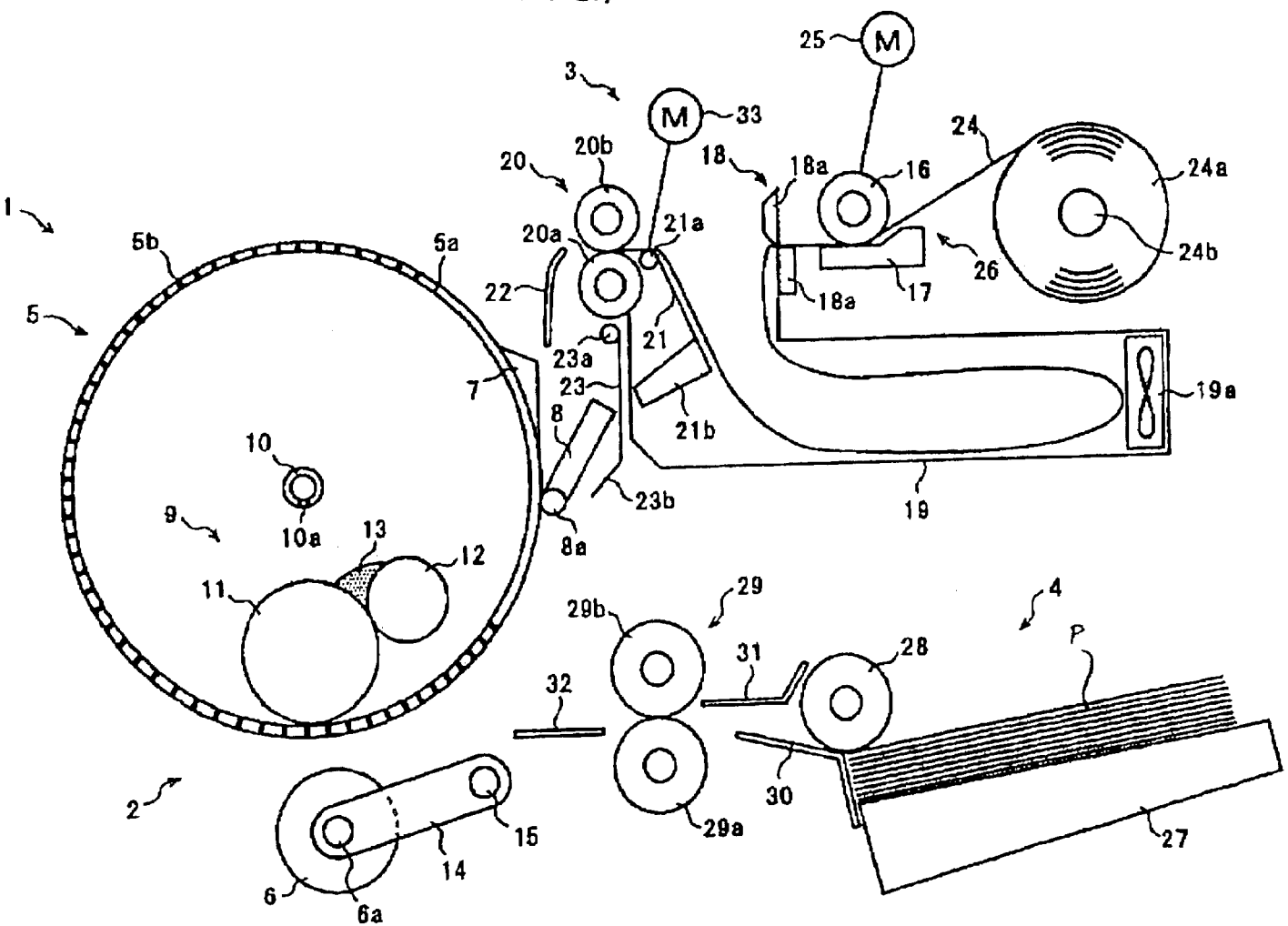
FIG. 3 is a front view showing the illustrative embodiment in a master making condition.

Even after the stop of rotation of the roller pair 20, the master making and conveying means 26 continuously operates with the result that the perforated part of the stencil 24 is introduced into the master stocking means 19 due to the suction of the suction fan 19*a*, as shown in FIG. 3. When the print drum 5 reaches the stand-by position shown in FIG. 3 after the discharge of the used master and the perforated stencil 24 is stocked in the master stocking means 19 by more than a preselected amount, the drive means again drives the roller pair 20. The roller pair 20 conveys the perforated stencil 24 toward a preselected position between the stage 7 and the clamper 8 held in the open position.

When the leading edge of the master 24 is determined to have reached the above position between the stage 7 and the clamper 8, the opening/closing means closes the clamper 8 to thereby retain the leading edge of the master 24 on the outer periphery of the print drum 5. At the same time, the drive means assigned to the roller pair 20 is deenergized for stopping the rotation of the roller pair 20. After the clamper 8 has been closed, the print drum 5 is caused to intermittently rotate clockwise at low speed, so that the master 24 is wrapped around the print drum 24.

Figure 4:
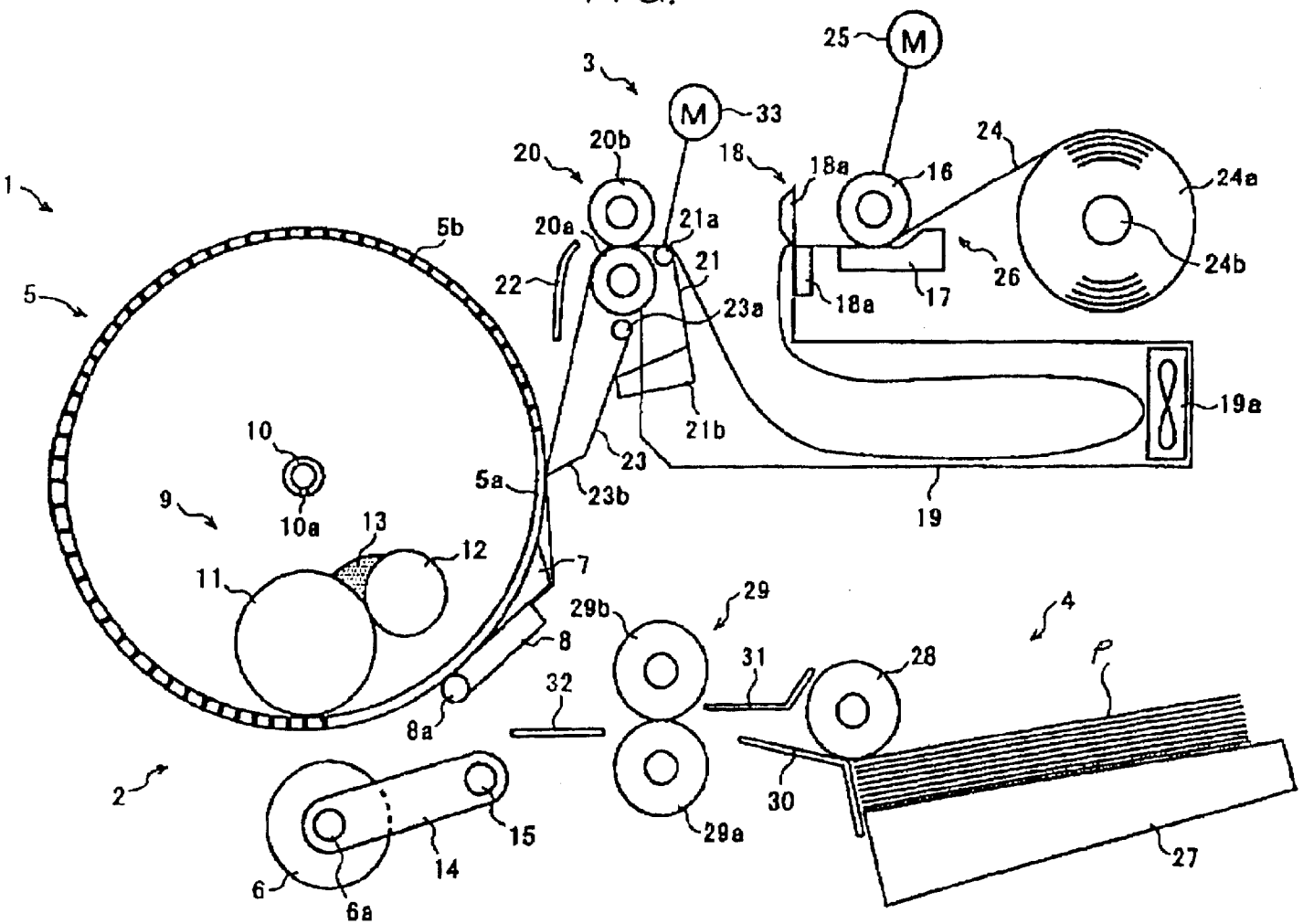
FIG. 4 is a front view showing the illustrative embodiment in a master wrapping condition.

When the print drum 5 is rotated to a preselected angle, the stepping motor 33 is energized to angularly move the movable master guide 21 further clockwise, as viewed 6 in FIG. 3, to the wrapping position shown in FIG. 4. At the wrapping position, the projection 21*b* of the movable master guide 21 protrudes to the outside of the master stocking means 19 via the opening mentioned earlier, causing the stretching member 23 to angularly move clockwise about the shaft 23*a* against the action of the biasing means. As a result, the contact portion 23*b* of the stretching member 23 contacts the stencil 24 present on the print drum 5. At this instant, the contact portion 23*b* elastically deforms to exert preselected pressure on the master 24, so that the master 24 closely contacts the surface of the print drum 5 without any slack.

When a single master 24 is determined to have been fully perforated in terms of the number of steps of the stepping motor 25, the stepping motor 25 is deenergized 25 while the cutting means 18 is operated to cut away the master 24. The master 24 thus cut away is pulled out from the master making and conveying section 3 by the print drum 5, which is in rotation, and fully wrapped around the print drum 5. At this instant, the contact portion 23*b* of the stretching member 23, continuously contacting the master 24, allows the master 24 to be wrapped around the print drum 5 without any slack from the beginning to the end of the wrapping operation.

Subsequently, the stepping motor 33 is operated to move the movable master guide 21 counterclockwise, as viewed in FIG. 4, about the shaft 21*a* to the guide position shown in FIG. 1. As a result, the stretching member 23 is angularly moved counterclockwise, as viewed in FIG. 4, about the shaft 23*a* under the action of the biasing means and therefore returned to the initial position shown in FIG. 1.

As soon as the movable master guide plate 21 and stretching member 23 are returned to the guide position and initial position, respectively, the pickup roller 28 pays out the top sheet P from the sheet tray 27 while, at the same time, the print drum 5 is caused to rotate clockwise at low speed. The sheet P, separated from the underlying sheets P by the separating member 30, is conveyed to the registration roller pair 29. The registration roller pair 29 stops the leading edge of the sheet P by nipping its leading edge and then starts conveying the sheet P toward the printing section 2 at such timing that the leading edge of the sheet P meets the leading edge of the image portion of the master 24, which is present on the print drum 5.

The press roller moving means mentioned earlier is operated substantially at the same time as the registration roller pair 29 in order to the press roller 6 into contact with the print drum 5. As a result, the porous support 5*a*, mesh screens, master 24, sheet P and press roller 6 are pressed against each other by preselected pressure, so that the ink, fed to the inner periphery of the print drum 5 by the ink roller 11, is transferred to the sheet P via the pores of the mesh screens, porous base of the master 24, and perforations formed in the thermoplastic resin film of the master 24. Consequently, the master 24 is closely adhered to the print drum 5. Thereafter, the print P is peeled off from the print drum 5 by the peeler and then driven out to the print tray by the conveyor although not shown specifically.

Subsequently, the operator inputs a desired image position, a desired print speed and other information by operating keys, not shown, arranged on the operation panel and then presses a trial print key not shown. In response, the print drum 5 is rotated at a peripheral speed matching with the desired print speed while one sheet P is fed from the sheet feeding section 4. As a result, a trial print is produced by the same procedure as in the step described above. If the image of the trial print is acceptable, as determined by eye, then the operator inputs a desired number of prints on the operation panel and then presses a print start key. In response, sheets P are continuously fed from the sheet feeding section 4 one by one, so that images are printed on the consecutive sheets P in the same manner as the image printed on the trial print. When the desired number of prints are fully produced, the printer 1 stops all the operations described above and again waits in the stand-by position.

As stated above, the stretching member 23 frees the master 24 present on the drum 5 from slackening and therefore creases ascribable thereto throughout the consecutive printing procedures stated above, thereby obviating defective prints. Further, a single stepping motor 33 causes the movable master guide 21 and stretching member 23 to move in interlocked relation to each other, so that the configuration is simple and low cost.

Figure 5A:
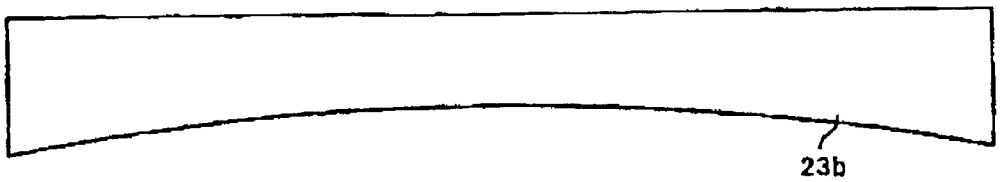
FIGS. 5A and 5B are views each showing a particular configuration of a stretching member included in the illustrative embodiment.
Figure 5B:
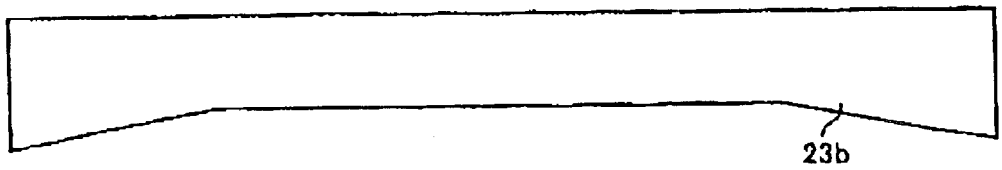

FIGS. 5A and 5B each show a particular modification of the rectangular contact portion 23*b* of the stretching member 23. The contact portion 23*b* shown in FIG. 5A has an arcuate configuration concave at the center while the contact portion 23B shown in FIG. 5B has a trapezoidal configuration also concave at the center. Such modified contact portions 23*b* each stretch the master 24 toward opposite side edges for thereby further effectively obviating slackening.

Figure 6:
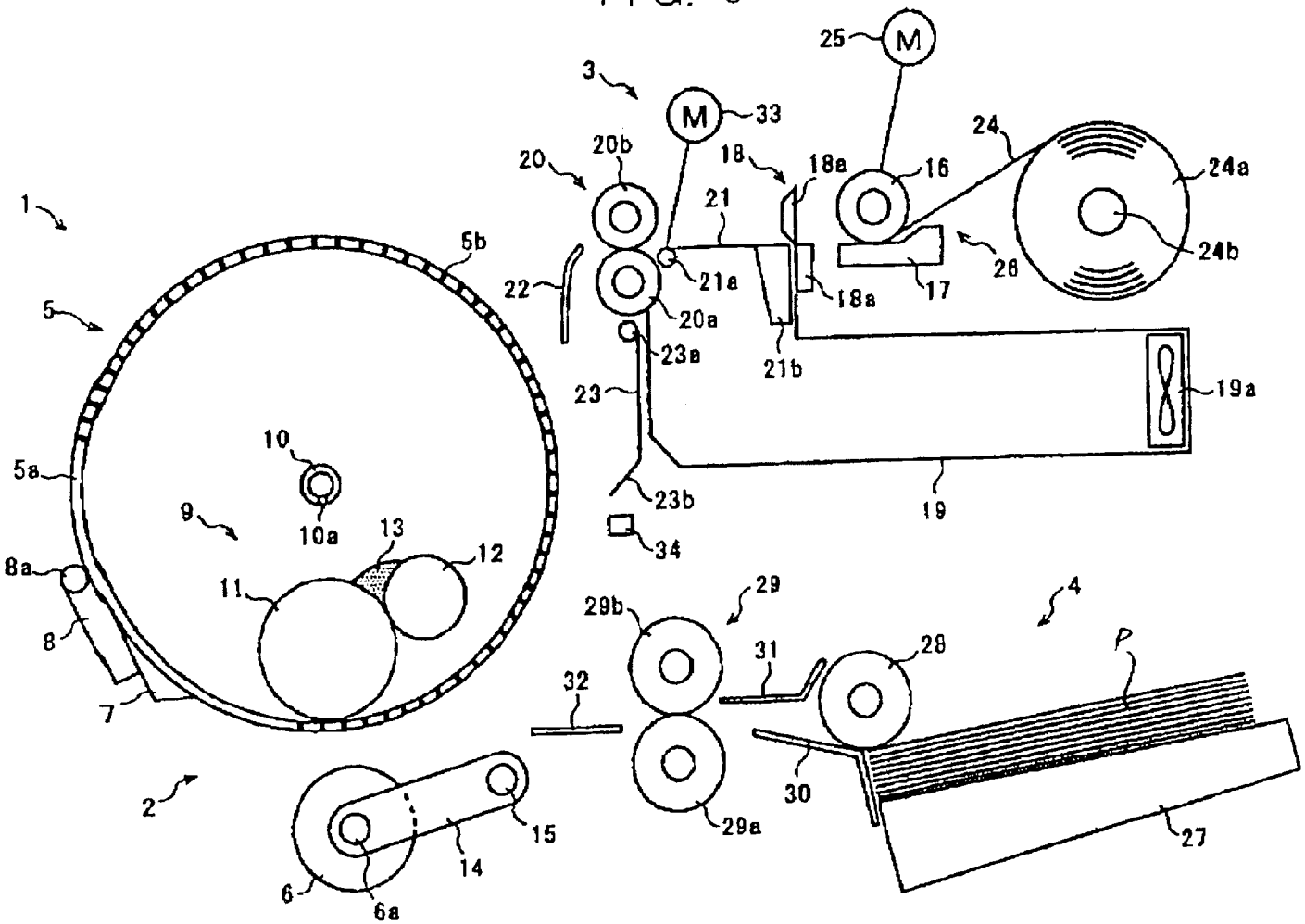
FIG. 6 is a front view showing an alternative embodiment of the stencil printer in accordance with the present invention in a stand-by condition.

Reference will be made to FIG. 6 for describing an alternative embodiment of the present invention. As shown, the alternative embodiment is identical with the previous embodiment only in that it additionally includes a master sensor or master sensing means 34. The master sensor 34, implemented as a reflection type sensor, is positioned in the vicinity of the outer periphery of the print drum 5 below the stretching member 23 for sensing the master 24 wrapped around the print drum 5.

In operation, the leading edge of the master 24, produced by the same procedure as in the previous embodiment, is expected to be clamped by the clamper 8. If the clamper 8 fails to clamp the leading edge of the master 24 due to some error, the print drum 5 starts rotating clockwise, as stated earlier, with the clamper 8 being closed without clamping the master 24. Subsequently, when the print drum 5 reaches the preselected angular position, the movable master guide 21 is moved to the wrapping position to contact the print drum 5 with the contact portion 23*b* thereof. At this instant, however, the master sensor 34 does not sense any master on the print drum 5 and sends a signal representative of the absence of a master to control means shown. In response, the control means determines that the master 24 is absent on the print drum 5, inhibits the operation of the stepping motor 33, and inhibits the movement of the movable master guide 21 to the wrapping position.

With the above configuration, the illustrative embodiment prevents the contact portion 23*b* from directly contacting the print drum 5 in the absence of the master 24 and being smeared by the ink. Further, the control means displays, when determined that the master 24 is absent on the print drum 5, a jam on the operation panel and then resumes the master making operation after conventional jam processing.

Figure 7:
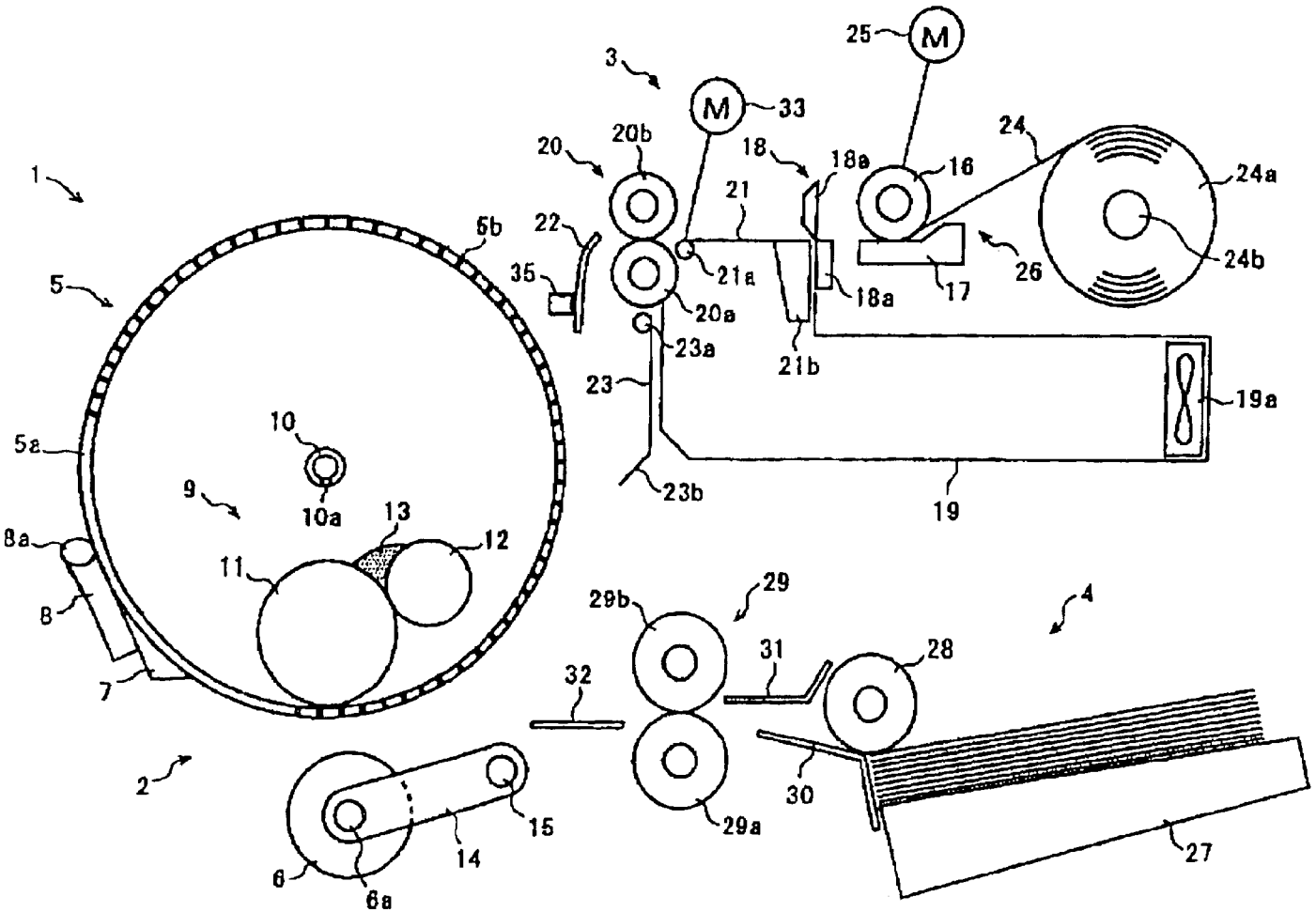
FIG. 7 is a front view showing another alternative embodiment of the stencil printer in accordance with the present invention in a stand-by condition.

FIG. 7 shows another alternative embodiment of the present invention. As shown, this embodiment is also identical with the embodiment described with reference to FIGS. 1 through 4 except that it additionally includes a trailing edge sensor or trailing edge sensing means 35. As shown, the trailing edge sensor 35, also implemented as a reflection type sensor, is mounted on the master guide 22 outside of the master conveyance path. The trailing edge sensor 35 emits light toward the master conveying path via an opening formed in the master guide 22 and determines, based on reflectance, whether or not the trailing edge of the master 24 has moved away from the master guide 22, and sends its output signal to the control means.

In operation, the master 24, produced by the same procedure as in the embodiment described with reference to FIGS. 1 through 4, is wrapped around the print drum 5. At this instant, the movable master guide 21 is located at the wrapping position, so that the contact portion 23*b* of the stretching member 23 presses the master 24 to thereby prevent it from slackening.

Subsequently, the master 24 is cut away and fully delivered out of the master stocking means 19. When the trailing edge sensor 35 senses the trailing edge of the master 24 moved away from the master guide 22, the sensor 35 sends a an output signal to the control means. In response, the control means energizes the stepping motor 33 for returning the movable master guide 21 to the guide position. At this instant, the stretching member 23 is returned to the initial position in interlocked relation to the above movement of the movable master guide 21.

As stated above, in the illustrative embodiment, the stretching member 23 is returned to the initial position just before the trailing edge of the master 24 is wrapped around the print drum 5. This prevents the contact portion 23*b* of the stretching member 23 from directly contacting the print drum 5 in the absence of the master 24 and being smeared by the ink.

It is a common practice with a stencil printer to use an encoder responsive to the position of the print drum 5 for thereby allowing the print drum 5 to stop at, e.g., a master discharge position or a master feed position. Further, the length of a single master 24 is usually identical with the length of the porous portion of the print drum 5 and constant without regard to the size of an image to be printed, so that the trailing edge of the master 24 is located at the same position on the surface of the print drum 5 without exception.

It follows that the position of the print drum 5 sensed by the encoder and the trailing edge position of the master 24 sensed by the trailing edge sensor 35 always remain in a preselected relation. For example, the trailing edge sensor 35 sends a signal to the control means when the encoder has output 1,000 pulses. Therefore, when the master 24 is torn during perforation by accident or when the master 24, formed a loop in the master stocking means 19, is folded up by the roller pair 20 in the form of letter Z, the trailing edge sensor 35 outputs a signal before the encoder outputs a preselected number of pulses. In such a case, the control means displays a jam message meant for the operator on the operation panel for thereby obviating defecting prints.

In the illustrative embodiments and modifications thereof shown and described, the stretching member 23 presses the master 24 while the print drum 5 is making one rotation for wrapping the master 24 therearound. Alternatively, the stretching member 23 may press the master 24 a plurality of times while the print drum 5 is making two or more rotations. This effectively prevents air from existing between the master 24 and the print drum 5 to thereby obviate creases more positively.

Also, in the illustrative embodiments and modifications thereof, a single stepping motor 33 causes the movable guide 21 to move into contact with the stretching member 23 and push the stretching member 23. Alternatively, the movable master guide 21 and stretching member 23 may be operatively connected together by gears, a belt or similar drive transmitting means, in which case either one of the master guide 21 and stretching member 23 will be moved by a motor, solenoid or similar actuator.

Further, in the illustrative embodiments and modifications thereof, when the movable master guide plate 21 is brought to the wrapping position, it causes the contact portion 23*b* of the stretching member 23 to press the master 24 being wrapped around the print drum 5 with preselected pressure.

Alternatively, the movable master guide 21 may be selectively moved to any one of a plurality of stepwise wrapping positions by finely controlling the number of steps of the stepping motor 33, varying the pressure of the contact portion 23*b* to act on the master 24. More specifically, an arrangement may be made such that when the operator inputs the kind of a stencil to use, e.g., a thin, an ordinary or a thick stencil on the operation panel, the control means controls the pressure of the contact portion 23*b* to act on the master 24 in accordance with the kind of the stencil input. For example, the controller may raise the pressure when the stencil 24 is relatively thin and soft and does not easily move on the print drum 5, thereby surely preventing the stencil 24 from creasing.

If desired, the contact portion 23*b* of the stretching member 23 may have its surface, which is to contact the master 24, coated with fluorine or otherwise treated for lowering frictional resistance. This allows the contact portion 23*b* to smoothly slide on the master 24 for thereby protecting the master 24 from scratches and reducing the amount of ink to deposit on the contact portion 23*b*.

In summary, it will be seen that the present invention provides a stencil printer in which a stretching member fully stretches a master wrapped around a print drum to thereby free the master from creases ascribable to slackening and therefore obviate detective prints ascribable to creases. Further, a single drive means causes a movable master guide and the stretching member to move in interlocked relation to each other, thereby simplifying the construction and reducing the cost of the stencil printer.

Various modifications will become possible for those skilled in the art after receiving the teachings of the present disclosure without departing from the scope thereof.

What is claimed is:

1. A stencil printer comprising:

a print drum around which a master is to be wrapped;

master making and conveying means for perforating a stencil paid out from a stencil roll while conveying said stencil to thereby produce the master;

master stocking means for stocking the master being conveyed by said master making and conveying means;

master conveying means for conveying the master out of said master stocking means;

a movable master guide configured to selectively guide the stencil paid out from the stencil roll to said master stocking means or said master conveying means; and a stretching member adjoining said print drum and configured to selectively move to a contact position where said stretching member contacts the stencil present on said print drum to thereby exert a stretching force on said master or a released position where said stretching member is released from said master;

wherein said stretching member and said movable master guide are interlocked to each other.

2. The stencil printer as claimed in claim 1, wherein said stretching member includes a thin, elastic contact portion capable of contacting the master present on said print drum.

3. The stencil printer as claimed in claim 2, wherein said contact portion is concave at a center portion relative to opposite edge portions.

4. The stencil printer as claimed in claim 1, wherein said stretching member and said movable master guide are moved by a single stepping motor.

5. The stencil printer as claimed in claim 1, wherein said movable master guide includes a projection configured to abut against and move said stretching member when said movable master guide is moved.

6. The stencil printer as claimed in claim 1, wherein a pressure of said stretching member to act on the master present on said print drum is variable.

7. The stencil printer as claimed in claim 1, further comprising master sensing means for sensing the master wrapped around said print drum, wherein when an output of said master sensing means indicates that the master is absent on said print drum, said stretching member is inhibited from moving to the contact position.

8. The stencil printer as claimed in claim 1, further comprising trailing edge sensing means for sensing a trailing edge of the master wrapped around said print drum, wherein when said trailing edge sensing means has sensed the trailing edge of said master, said stretching member is moved to the released position.

* * * * *